United States Patent [19]

Henderson

[11] 4,226,399

[45] Oct. 7, 1980

[54] GUN BARREL LOCK

[76] Inventor: George H. Henderson, 1098 Meadow Dr., Lennon, Mich. 48449

[21] Appl. No.: 961,132

[22] Filed: Nov. 16, 1978

Related U.S. Application Data

[63] Continuation-in-part of Ser. No. 926,494, Jul. 20, 1978.

[51] Int. Cl.[2] ..... A47B 96/06; A47F 7/00

[52] U.S. Cl. ..... 248/553; 70/226; 211/64

[58] Field of Search ..... 70/226, 227, 234, 235, 70/233, 18, 14; 211/8, 9, 64, 5; 292/216, 45, 106, 207, 198; 248/553

[56] References Cited

U.S. PATENT DOCUMENTS

| | | | |
|---|---|---|---|
| 538,170 | 4/1895 | Kelley | 70/226 |
| 611,401 | 9/1898 | White | 70/234 |
| 1,167,688 | 1/1916 | Fuller | 70/226 X |
| 1,216,660 | 2/1917 | Conway | 70/227 X |
| 1,228,631 | 6/1917 | Wolfe | 211/9 |
| 1,242,848 | 10/1917 | Pale | 70/227 |
| 1,431,139 | 10/1922 | Norton | 248/553 |
| 1,478,154 | 12/1923 | Weir | 248/553 |
| 3,473,673 | 10/1969 | Porter | 211/64 |

FOREIGN PATENT DOCUMENTS

| | | | |
|---|---|---|---|
| 373263 | 4/1923 | Fed. Rep. of Germany | 70/226 |
| 161523 | 4/1922 | United Kingdom | 70/233 |

*Primary Examiner*—J. Franklin Foss

*Attorney, Agent, or Firm*—Arnold S. Weintraub

[57] ABSTRACT

A locking mechanism for effectuating the locking of individual gun barrels to a wall or gun case which includes at least one rotatable jaw which is in opposition to an opposite jaw. The opposite jaw may be either rotatable or fixed. The configuration of the jaws causes them, when locked, to envelope or encircle the gun barrel thereby locking the gun in place.

7 Claims, 5 Drawing Figures

FIG-2
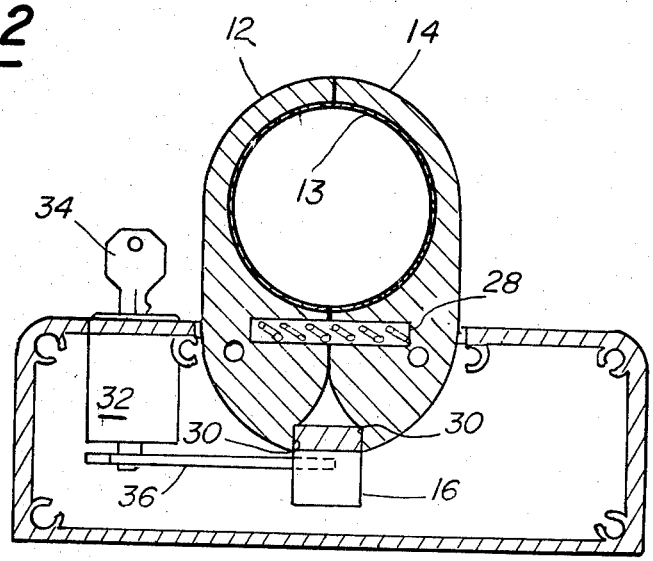
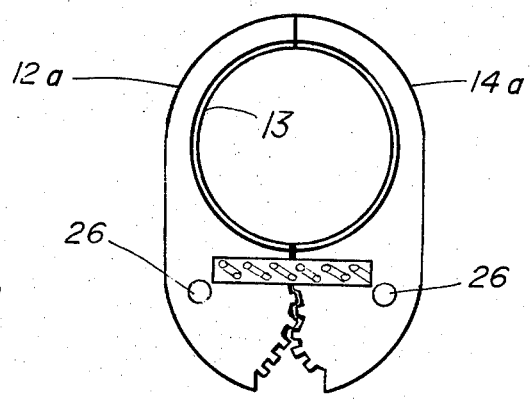
FIG-4
FIG-5
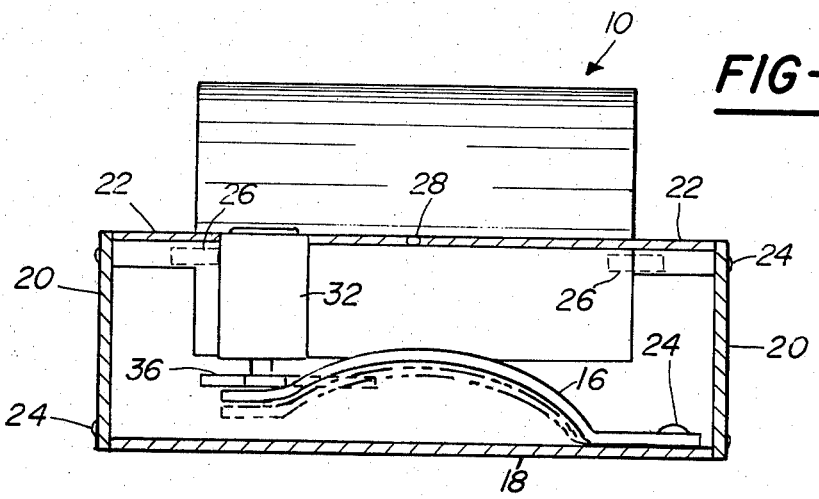

GUN BARREL LOCK

CROSS REFERENCE TO RELATED APPLICATIONS

The present application is a continuation-in-part of copending application Ser. No. 926,494 filed July 20, 1978, entitled "WHEEL LOCK".

BACKGROUND OF THE INVENTION

I. Field of the Invention

The present invention pertains to locking mechanisms. More particularly, the present invention concerns locking mechanisms for locking gun barrels in place.

II. Description of the Prior Art

Normally, in locking guns in place a chain or similar device is passed through the trigger guard and the ends of the chain are secured to a wall. Such means for locking guns is unsatisfactory because the chain can mar the finish on the gun. Also, when a group of guns is secured by one chain it is necessary to remove the guns at the end of the chain to reach any gun located in the center of the group.

III. Prior Art Statement p To the best of the Applicant's knowledge, the most closely related art is found in the following U.S. Pat. Nos.

3,981,166,
3,910,381,
3,844,146,
3,805,564,
3,785,500,
3,762,569;
2,010,770;
1,688,496;
1,386,414;
1,218,843.

The present invention is distinct therefrom in the assemblage of its elements and the locking of the rotable jaws.

SUMMARY OF THE INVENTION

The present invention provides a lock which encircles individual gun barrels. The inner surface of the jaw is covered with felt or other like soft material which protects the finish of the barrel. Furthermore, an individual gun can be removed by itself without disturbing guns locked adjacently.

The present invention provides a new gun barrel locking means which is attractive in appearance and inexpensive to produce while protecting the appearance of the gun barrel it is securing.

In accordance with the present invention there is provided a locking means or mechanism for locking guns to a wall or cabinet or the like. The locking mechanism comprises a pair of opposed jaws, at least one of which is pivotally mounted and moveable with respect to the other jaw. In one embodiment the jaws are provided with intermeshing gears for synchronization of the movement therebetween.

When the jaws are in abutting relationship to envelope the gun barrel, a leaf spring anchored at one end to a wall of a housing, with its free end biased toward the jaws engages a recess in the jaws to hold the jaws in abutment and prevent release of the barrel.

For a more complete understanding of the present invention, reference is made to the following detailed description and accompanying drawing.

BRIEF DESCRIPTION OF THE DRAWINGS

In the drawing, like reference characters refer to like parts throughout the several views in which:

FIG. 2 is a cross sectional view of the gun barrel lock in FIG. 1 taken along a plane B—B perpendicular to the bottom, with the jaws in the locked position;

FIG. 4 is a cross sectional view of another embodiment of the jaws wherein the jaws are geared together to move synchronously.

FIG. 5 is a cross sectional view of FIG. 1 taken along 5—5 in FIG. 1 and being perpendicular to the bottom.

DESCRIPTION OF THE PREFERRED EMBODIMENT

Figure 1:
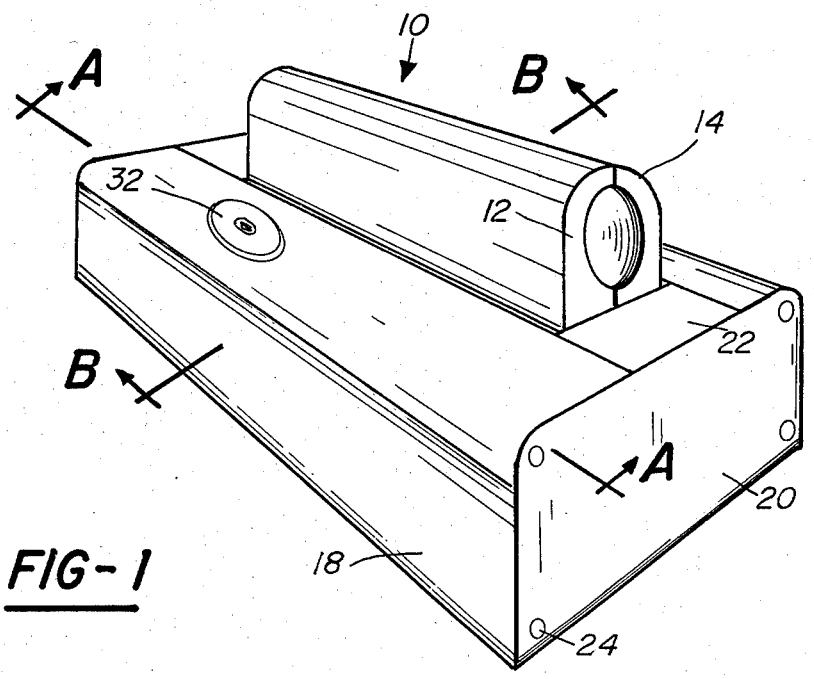
FIG. 1 is a perspective view of the gun barrel lock.

Now, and with reference to the drawing, and in particular, FIGS. 1–5, there is depicted a first embodiment of the present invention, generally denoted at 10. The locking mechanism 10 hereof generally comprises:

(a) a pair of opposed jaws 12, 14; (b) means for rendering at least one of the jaws pivoted to the housing and pivotally rotatable towards the opposed or opposite jaw; (c) a leaf spring denoted at 16 which is anchored at one end to a housing and having a ramp at its free end is biased toward the lower end of the jaws. The leaf spring drops into a recess in the lower end of the jaws for locking the jaws in place when they are in abutment with each other. A lock 32 rotatable by means of a key 34 has journalled to its lower end a release plate 36 which rotates with the key 34. Rotating the release plate toward the leaf spring 16 moves the spring along the ramp and away from the jaws 12, 14 releasing the spring from the recess 30 allowing the jaws to open.

The inner surface of the jaws where they contact the gun barrel, are covered with felt 13 or other soft material to prevent scratching or otherwise damaging the barrel. It should be noted that the present invention contemplates the provision that at least one jaw 12 or 14 which is pivotally rotatable toward an opposite jaw which may or may not be moveable. However, for the purpose of facilitating and understanding the present invention, the ensuing description will be of a preferred embodiment wherein the jaws are both pivotally moveable or rotatable.

Figure 3:
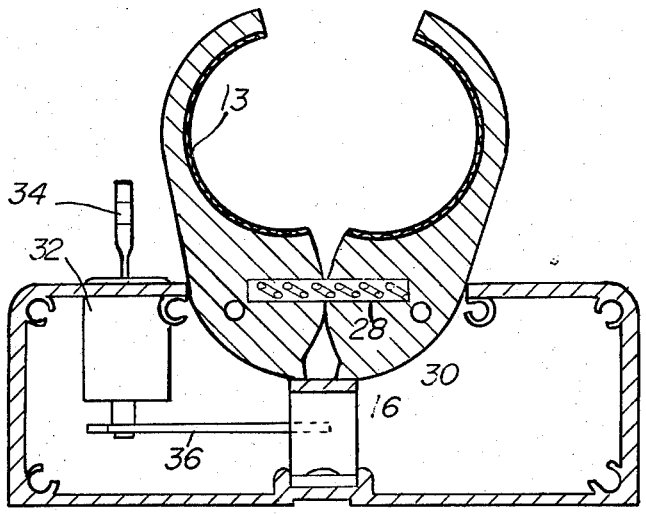
FIG. 3 is a cross sectional view as in FIG. 2 with the jaws opened.

Referring again to the drawing, and in particular to FIGS. 2, 3, and 5 hereof and with more particularity, the locking mechanism comprises a housing 18 with end covers 20, and top closure pieces 22. A plurality of drive rivets 24 hold the pieces together to form an enclosure. The housing 18 has an opening along the top, throughout its length, with jaws 12, 14 projecting therethrough. The leaf spring 16 is anchored at one end to the housing and the free end is biased toward the jaws 12, 14. A rotatable cylinder lock 32 is operatd by a key 34 and has journalled at its inner end a release plate 36. When the release plate 36 is rotated toward the anchored end of leaf spring 16, it moves up the ramp of leaf spring 16 urging it down. When leaf spring 16 is urged down with sufficient force it leaves recess 30 allowing jaws 12, 14 to be urged open by a compressed spring 28. When a gun barrel has been placed in the opening between the jaws 12, 14, the jaws are closed by the user's fingers urging the jaws into abutment. When the jaws 12, 14 are in abutment the leaf spring 16 drops into the recess 30 holding the jaws in abutment until the lock is opened by the key 34.

It should be noted that FIG. 4 shows another embodiment of jaws 12*a*, 14*a*, wherein their lower adjacent edges having meshing gears formed to rotate about pivots 26, forcing jaws 12*a* and 14*a* to move synchronously from abutment to open position.

Having thus described the invention, what is claimed is:

1. A gun barrel locking mechanism comprising:

a pair of opposed jaws, adapted to matingly abut, the jaws being configured to encircle the barrel of a gun when in mating abutment;

at least one pivot, the pivot mounting one jaw thereon such that at least one jaw is pivotally rotatable toward the other jaw, first means for locking the pivotally rotatable jaw against rotation when jaws are in mating abutment, said first means for locking comprising:

a housing associated with the pivotal jaw;

a leaf spring attached at one end to said housing;

the free end of said leaf spring biased toward said jaw; and wherein the jaw has an indentation therein which received the leaf spring upon mating abutment of the jaws, the leaf spring preventing rotation of the pivotal jaw when in said indentation.

2. A gun barrel locking mechanism comprising:

a pair of opposed jaws, adapted to matingly abut, the jaws being configured to encircle the barrel of a gun whenin mating abutment;

at least one pivot, the pivot mounting one jaw thereon such that at least one jaw is pivotally rotatable toward the other jaw;

first means for locking the pivotally rotatable jaw against rotation when jaws are in mating abutment;

a housing of extruded configuration with a slot along the top allowing the jaws to project therethrough;

a pair of top closure pieces slidingly locked along the sides between the opening of said slot, said top closure pieces extending from the ends of said jaws to the end of said housing;

said top closure pieces having at their inner edges pivots to engage said jaws; and a pair of end closures attached to the ends of said housing.

3. The gun barrel locking mechanism of claim 2 wherein said leaf spring is attached to one of said end closures.

4. The gun barrel locking mechanism of claim 2 further comprising a coil spring between said jaws biasing said jaws open.

5. The gun barrel locking mechanism of claim 2 further copmprising a soft material lining the inner surface of said jaws.

6. The gun barrel locking mechanism of claim 2 with the locking means comprising:

a rotatable cylinder lock extending into the interior of said housing;

a release plate journalled onto the interior end of said cylinder lock and rotatable therewith; and said release plate biasing said leaf spring away from said jaws when rotated toward the unlocked position.

7. The gun barrel locking mechanism of claim 6 with means for sychronizing the movement of the opposed jaws as they move toward one another.

* * * * *

UNITED STATES PATENT AND TRADEMARK OFFICE

CERTIFICATE OF CORRECTION

PATENT NO. : 4,226,399

DATED : October 7, 1980

INVENTOR(S) : George H. Henderson

It is certified that error appears in the above-identified patent and that said Letters Patent are hereby corrected as shown below:

Column 1, line 26, following "Statement" delete "p";

spelling of "received" should be --receives--;

Column 4, line 23, following "ther" the correct spelling of "copmprising" should be --comprising--;

Signed and Sealed this

*Twentieth* Day of *January 1981*

[SEAL]

*Attest:*

RENE D. TEGTMEYER

*Attesting Officer*

*Acting Commissioner of Patents and Trademarks*